US007231992B2

(12) United States Patent
Papousek

(10) Patent No.: US 7,231,992 B2
(45) Date of Patent: Jun. 19, 2007

(54) DRILL BIT

(75) Inventor: Herbert Papousek, St. Magdalen bei Villach (AT)

(73) Assignee: Atlas Copco MAI GmbH, Feistritz/Drau (AT)

( * ) Notice: Subject to any disclaimer, the term of this patent is extended or adjusted under 35 U.S.C. 154(b) by 0 days.

(21) Appl. No.: 11/253,603

(22) Filed: Oct. 20, 2005

(65) Prior Publication Data

US 2006/0032676 A1 Feb. 16, 2006

Related U.S. Application Data

(62) Division of application No. 10/478,007, filed as application No. PCT/AT02/00149 on May 16, 2002, now Pat. No. 7,070,010.

(30) Foreign Application Priority Data

May 17, 2001 (AT) ..... A 789/01

(51) Int. Cl.
*E21B 10/36* (2006.01)

(52) U.S. Cl. ..... 175/415; 175/395; 175/430

(58) Field of Classification Search ..... None
See application file for complete search history.

(56) References Cited

U.S. PATENT DOCUMENTS 3,997,279 A * 12/1976 Porter ..... 408/211
4,185,708 A 1/1980 Janikowska-Pawlik et al.
5,810,517 A * 9/1998 Bostic ..... 407/53

FOREIGN PATENT DOCUMENTS

AT 001 513 U1 6/1997
DE 918 741 10/1954

* cited by examiner

*Primary Examiner*—Zakiya W. Bates
(74) *Attorney, Agent, or Firm*—Young & Thompson

(57) ABSTRACT

A drill bit has, on its face, a combination of at least one straight cutting edge and at least two curved cutting edges arranged in a Y-shape. The cutting edges on the face of the drill bit are arranged such that they start from the axis of the drill bit or end directly adjacent thereto. The straight cutting edge is symmetrical with respect to the curved cutting edges, which are curved in opposite directions.

7 Claims, 6 Drawing Sheets

DRILL BIT

This application is a division of application Ser. No. 10/478,007 now U.S. Pat. No. 7,070,010, filed on Nov. 17, 2003. Application Ser. No. 10/478,007 is the national phase of PCT International Application No. PCT/AT02/00149 filed on May 16, 2002 under 35 U.S.C. § 371, which claims priority of Austrian Application No. A 789/01 filed May 17, 2001. The entire contents of each of the above-identified applications are hereby incorporated by reference.

BACKGROUND OF THE INVENTION

The invention relates to a drill bit.

Drill bits, especially percussive or rotary percussive drill bits, with a cutting head which on its face has cutters for detaching and/or crushing the material to be worked, are known in various embodiments.

These drill bits are used for example on the front end of self-boring injection drill anchors which are set to protect rock against rock thrust.

A drill bit of the initially mentioned type is known from AT 001 513 U1. The known drill bit on its face has cutters which run in at least two different axial directions of the face. AT 001 513 U1 shows various combinations of straight and curved cutters on the face of a drill bit.

A drill bit with a curved cutter or with one curved and one straight cutter, or with one straight cutter or finally with two cutters which are parallel to one another is known from DE 918 741 A.

Similar arrangements of cutters for drill bits are known from GB 189 021 A.

SUMMARY OF THE INVENTION

The object of the invention is to develop a drill bit of the initially mentioned type such that by the shape and arrangement of the cutters better efficiency of the drill bit is achieved and a tighter-stop picture is obtained when it is used in rotary-percussive drilling.

The arrangement of the cutters on the face of the bit as provided in the drill bit as claimed in the invention, regardless of whether they are curved or straight, yields the desired efficiency of the drill bit as claimed in the invention which is improved compared to the known drill bits.

Drill bits, especially percussive or rotary percussive drill bits with a cutting head which on its face bears cutters for removing or crushing the material to be worked have at least one channel which discharges in the face of the drill bit (AT 00 151 341). While drilling, a flushing medium (for example, water or air) emerges from this channel, cools the drill bit during drilling and flushes the drillings out of the drilled hole. After the drilled hole has reached the desired depth, a cementing mass (for example, mortar or concrete) is forced out of the channel and after setting fixes the injector drill anchor in the drilled hole. These known drill bits have the disadvantage that the channel from which the flushing medium is designed to emerge is often clogged by drillings, especially when drilling in soft rock, such as sandstone.

Furthermore the object of the invention is to develop these drill bits such that there is no danger that the channel will become clogged by drillings in the course of drilling.

Since in the drill bit as claimed in the invention which is intended especially for use in injection drill anchors, at least one mouth of at least one channel through which first flushing medium and then setting mass, for example bonding (cement) mortar, is forced in order to fix the injection drill anchor in the drilled hole, in the plane defined by the cutters of the drill bit in the essentially vertical side surfaces of the drill bit the channel is prevented from being clogged with drillings when using the drill bit for drilling and thus passage through at least one channel in the drill bit during flushing during the drilling process and when forcing out the binding mass is reliably not hindered.

In the drill bit as claimed in the invention it is preferred that the mouth of at least one channel lies in one surface of the drill bit which is set back relative to the periphery of the drill bit.

BRIEF DESCRIPTION OF THE DRAWINGS

Other features, details and advantages of the drill bits as claimed in the invention result from the following description of drill bits as claimed in the invention.

DESCRIPTION OF THE PREFERRED EMBODIMENTS

Figure 1:
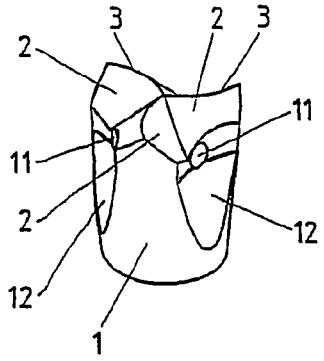
FIG. 1 shows a drill bit of a first embodiment in an oblique view.
Figure 2:
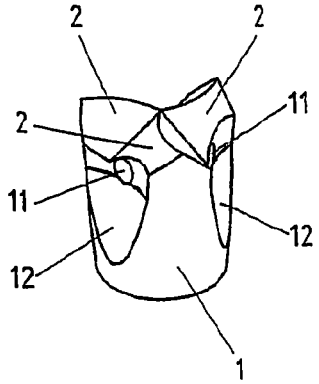
FIG. 2 shows the drill bit from FIG. 1 in another oblique view.

In the embodiment shown in FIGS. 1 to 8 the drill bit 1 on its face has three cutters 2 which are curved with the same radius of curvature and in the same direction, with cutting edges 3 which run toward the middle of the face and which meet one another in the middle, i.e. in the axis 4 of the drill bit 1.

In the drill bit 1 there is a blind hole 5 which emerges from the end of the drill bit 1 opposite the face surface and which has an inside thread so that the drill bit 1 can be screwed onto an anchor rod which has an external thread, as is used for injection drill anchors. From the blind hole 5 in the illustrated embodiment three channels 10 emerge which are tilted to the axis 4 of the drill bit 1 at an acute angle, for example an angle of 30° (compare FIG. 6). The channels 10 are aligned in the drill bit 1 such that their mouths 11 discharge on the side surface of the drill bit 1 in the area between two adjacent cutters 2.

Figure 6:
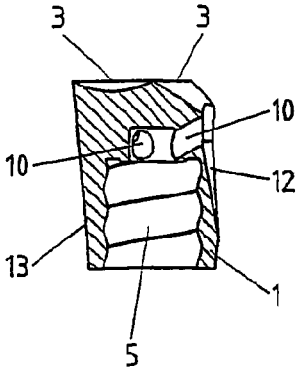
FIG. 6 shows a section along line VI—VI in FIG. 3.
Figure 7:
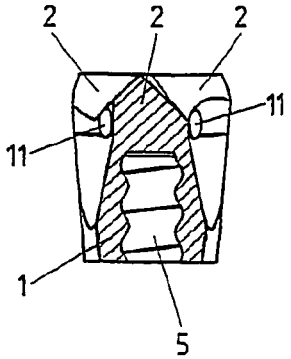
FIG. 7 shows a section along line VII—VII in FIG. 5.
Figure 8:
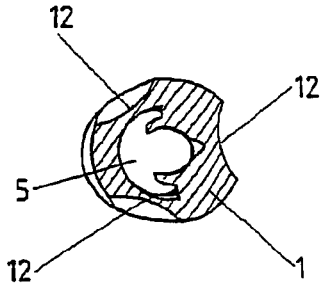
FIG. 8 shows a section along line VIII—VIII in FIG. 4.

The discharges 11 of the channels 10, as is shown for example in FIGS. 1 to 4 and especially the section from FIG. 6, lie in the area of concavely curved surfaces 12 which are roughly normal to the plane which is defined by the cutting edges 3, therefore essentially to the face of the drill bit 1. For this reason and due to the circumstance that the outside surface 13 of the drill bit 1 is made as a cone (truncated cone) which widens toward the face and which for example has an opening angle of 10° (compare FIG. 3 and 6), the mouths 11 of the channels 10 are arranged such that the channels 10 when drilling cannot be clogged with drillings. This contrasts with the embodiment of known drill bits (compare for example AT 001 513 01) in which the channels discharge in the area of the face of the drill bit.

The embodiment of a drill bit 1 as claimed in the invention which is shown in FIGS. 1 to 8 is designed for one direction of rotation in which the concave sides of the cutters 2 in the direction of rotation point to the outside.

Figure 9:
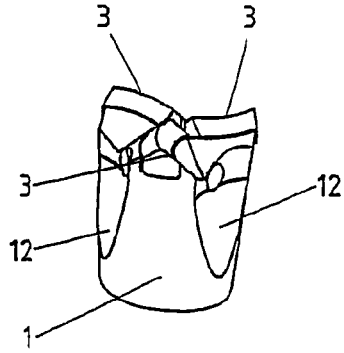
FIG. 9 shows in an oblique view a second embodiment of a drill bit as claimed in the invention with cutters formed by hard metal inserts, FIGS. 10 to 21 schematically show the arrangement and shape of cutters, each with the assigned stop picture (cutting picture) of embodiments with the drill bit as claimed in the invention.
Figure 3:
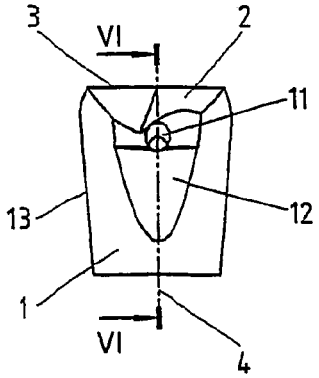
FIG. 3 shows the drill bit from FIG. 1 in a side view.
Figure 4:
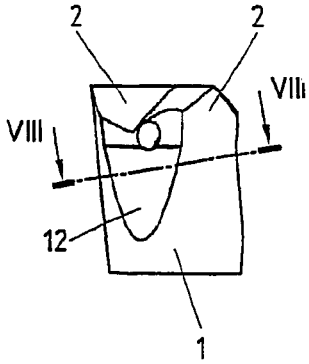
FIG. 4 shows the drill bit from FIG. 1 in another side view.
Figure 5:
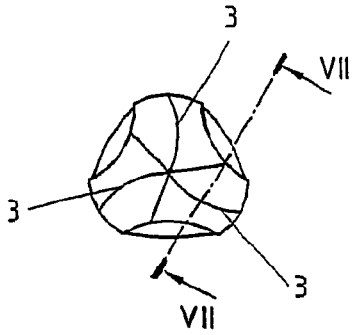
FIG. 5 shows the drill bit from FIG. 1 in a face view.

In the embodiment of a drill bit as claimed in the invention which is shown in FIG. 9, which bit is otherwise made as has been described for the drill bit 1 of FIGS. 1 to 8, the cutting edges 2 are formed by hard metal inserts 20 which are attached in the drill bits 1, for example by shrinking. In this embodiment the cutters 2 and their cutting edges 3 end with a distance from the axis 4 of the drill bit 1.

Figure 11:
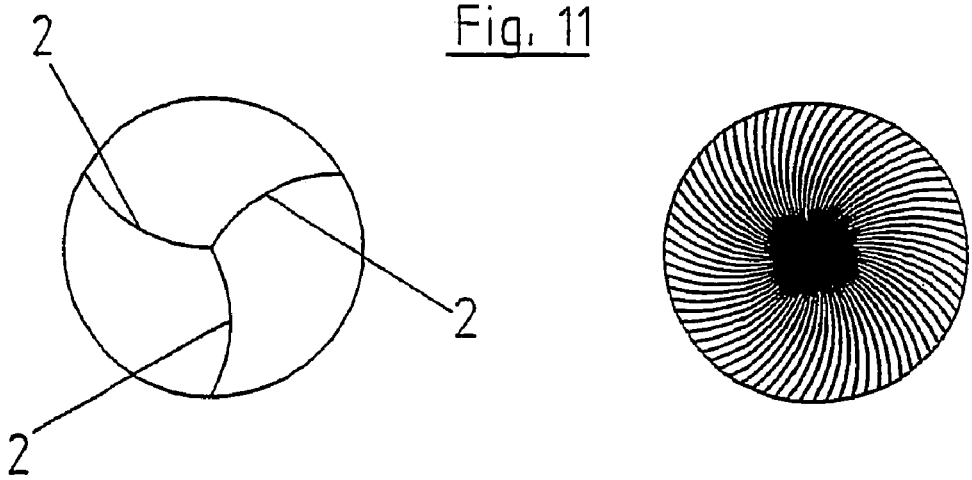

The shape of the cutters 2 which is shown in the embodiments of the drill bit 1 as claimed in the invention as shown in FIGS. 1 and 9 is shown schematically in FIG. 11 together with the pertinent stop picture.

Figure 15:
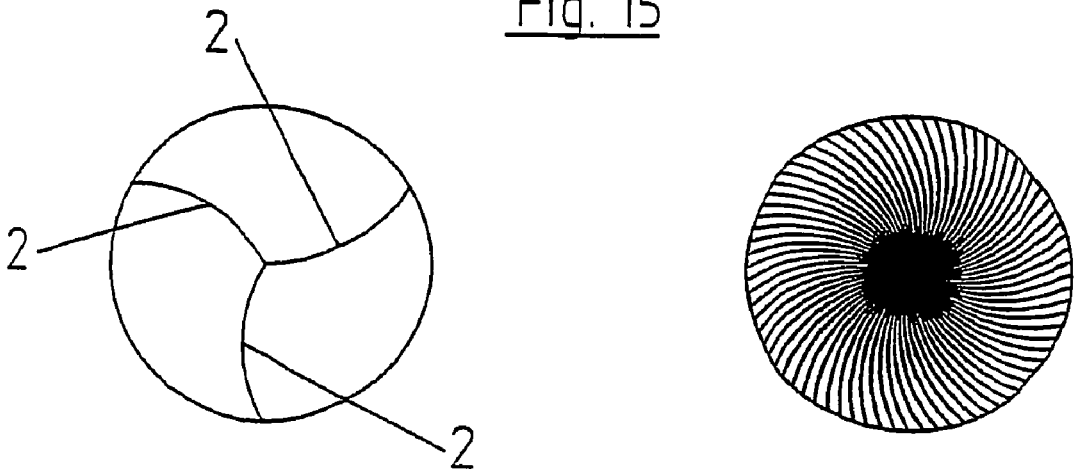

The cutters 2 of the drill bit 1 as claimed in the invention can however also be curved for certain applications such that the convex sides of the cutters 2 and the cutting edges 3, as is shown in FIG. 15, point forward relative to the direction of rotation.

In addition to embodiments of the drill bit 1 as claimed in the invention with exclusively curved surfaces 2 which can preferably meet essentially in the center of the face of the drill bit 1, other arrangements and combinations of cutters are also conceivable.

Figure 10:
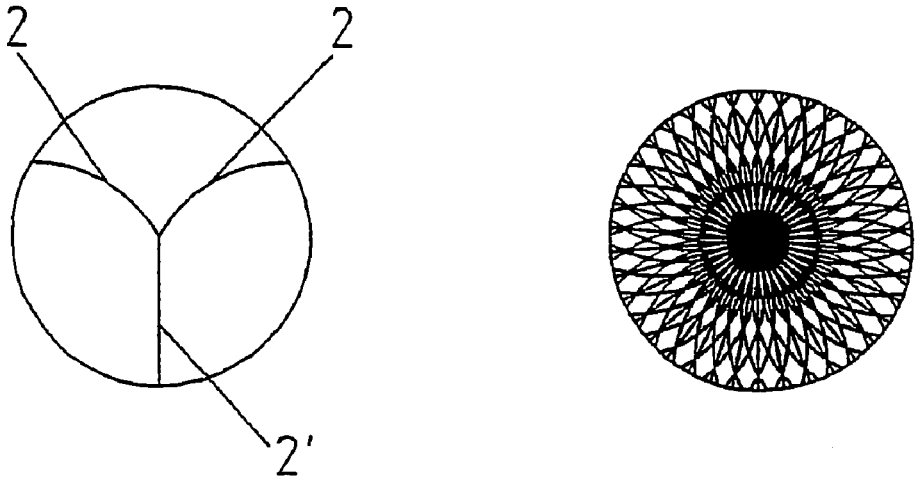

Thus for example FIG. 10 shows (schematically) the face of a drill bit 1 in which two cutters 2 which are oppositely curved relative to the direction of rotation and which are combined with a straight cutter 2' which likewise emerges from the center of the face of the drill bit 1 so that the stop picture likewise shown in FIG. 10 results.

In the embodiment show in FIG. 10 the straight cutter 2' relative to the axis 4 of the drill bit 1 is opposite in the area of the face of the drill bit 1 in which the cutters 2 which are curved in opposite directions are located.

Figure 12:
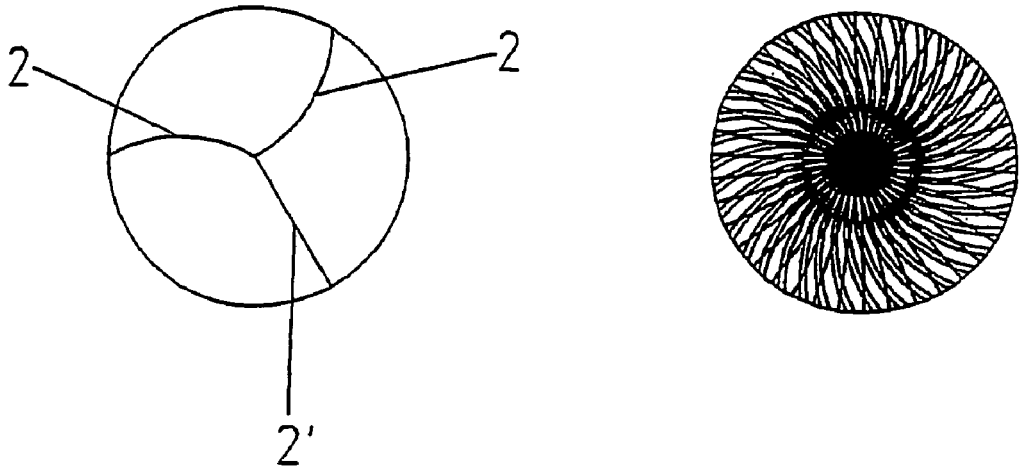

In the embodiment shown in FIG. 12 a straight cutter 2' is combined with two cutters 2 which are curved in the same direction. This yields the stop picture which is shown likewise in FIG. 12.

In addition to the embodiments of the drill bit 1 as claimed in the invention with three cutters 2 or 2', embodiments with more than three cutters 2, 2', for example four cutters, are also possible. Here drill bits 2 with exclusively curved cutters 2 and drill bits 1 with a combination of at least one straight cutter 2'and at least one curved cutter 2 are likewise possible, as in the above described embodiments with three bits 2, 2'.

Figure 13:
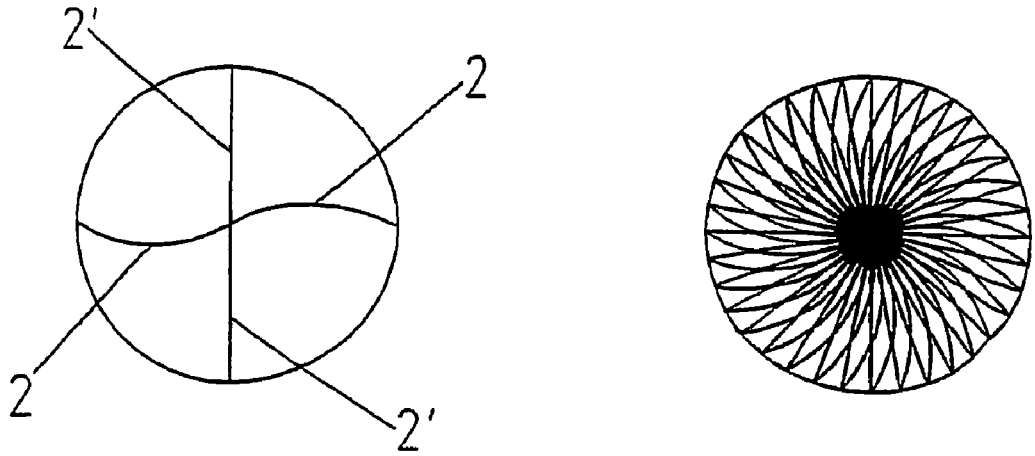

One example of this is shown in FIG. 13 in which two straight cutters 2' which are opposite one another relative to the axis 4 of the cutting head 1 are combined with two cutters 2 which are curved in the same direction relative to the direction of rotation and which likewise are located opposite one another with respect to the axis 4. The stop picture of this embodiment of a drill bit as claimed in the invention is likewise shown in FIG. 13.

Figure 14:
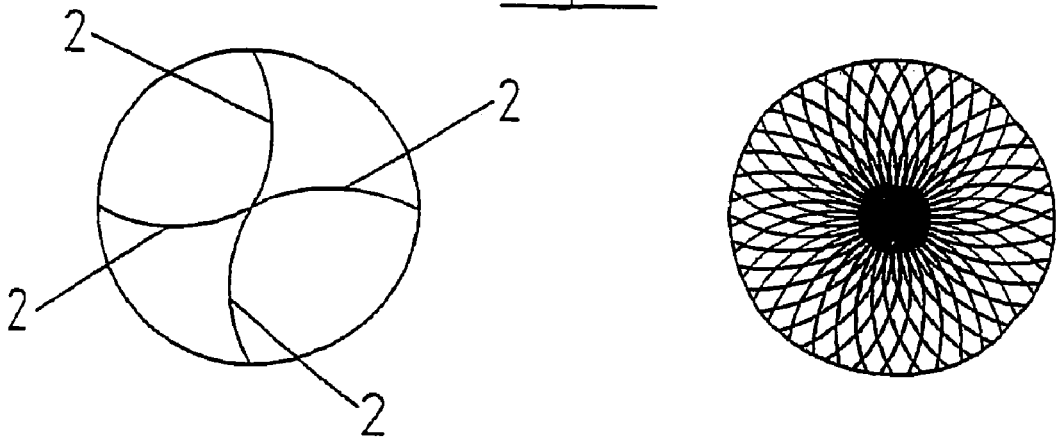

FIG. 14 schematically shows one embodiment in which on the face of the drill bits 1 there are exclusively curved cutters 2, specifically four cutters 2 which all proceed essentially from the center of the face of the drill bit 1, i.e. from its axis 4. In the shape and arrangement of the cutters selected in FIG. 14, the cutters 2 are curved alternatively in opposite directions, so that two cutters 2 which are opposite one another with respect to the axis 4 of the drill bit 1 make up into a surface S.

Figure 16:
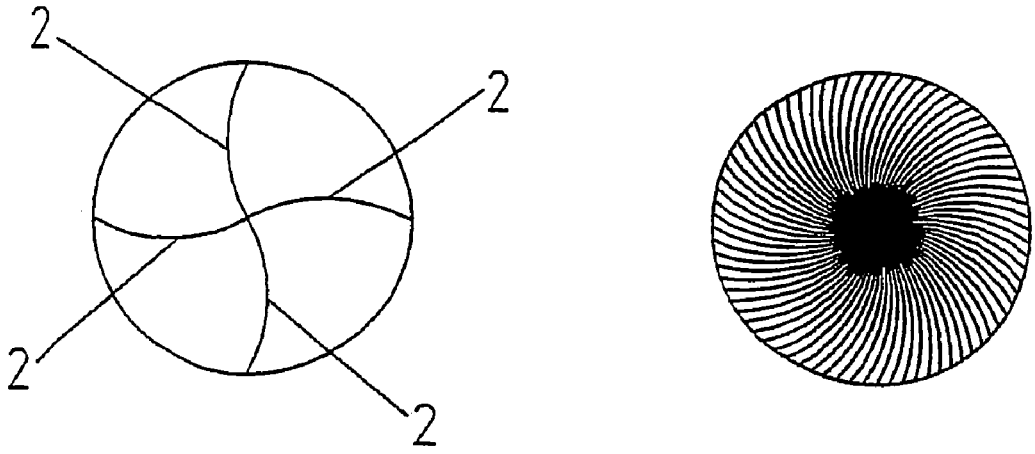

In the embodiment shown in FIG. 16, there are four cutters 2 which are all curved in the same direction, here too similarly to the embodiment shown in FIGS. 11 and 15 the curvature of the cutters 2 being chosen such that relative to the axis of rotation either their convex or their concave sides point forward.

Figure 17:
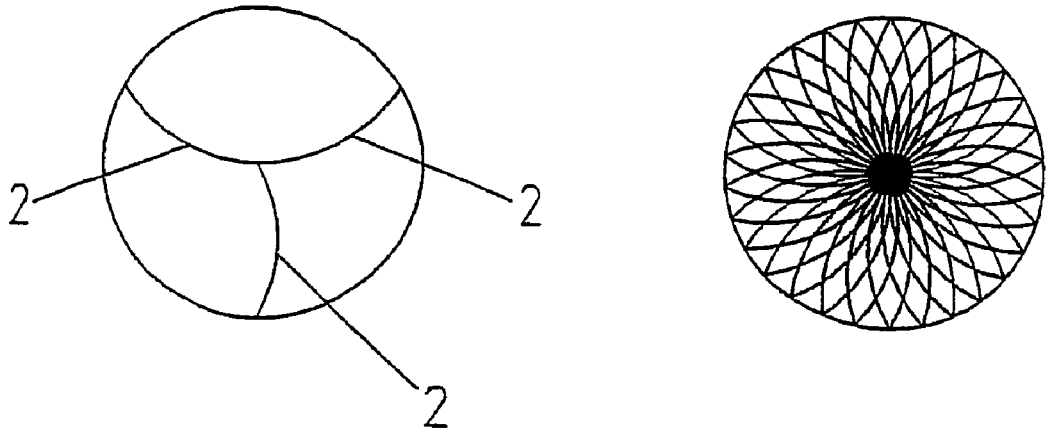
Figure 18:
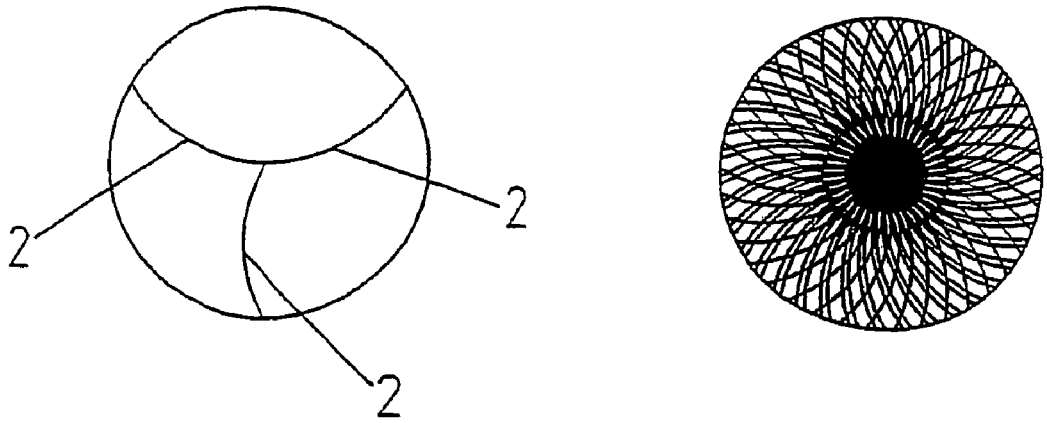

In the embodiments of the drill bits of the invention of FIGS. 17 and 18, there are three curved cutters 2 which are arranged and aligned such that two of the three cutters make up into a continuous arc and the third curved cutter 2 is located from the convex side of that of the other two cutters which make up into a continuous arc.

Figure 19:
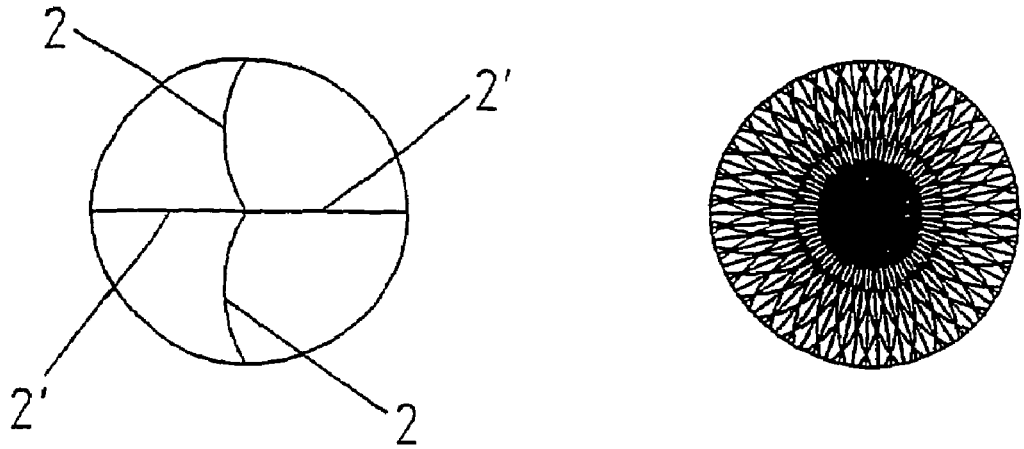
Figure 22:
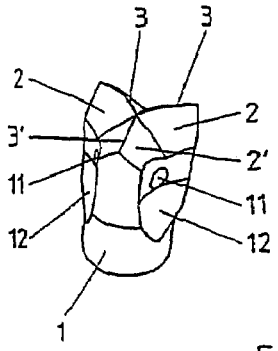
FIGS. 22, 23, 24, and 25 show in different views a drill bit with the arrangement/execution of the cutters as shown in FIG. 10.
Figure 23:
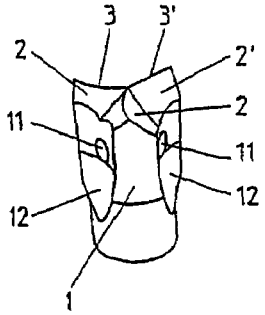
Figure 24:
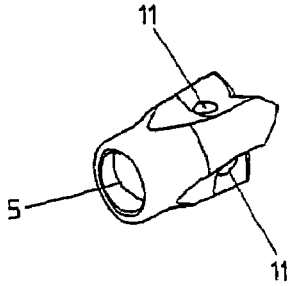
Figure 25:
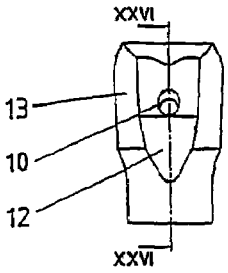
Figure 26:
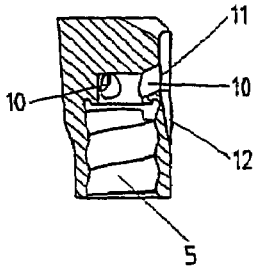
FIG. 26 shows a section along line XXVI—XXVI in FIG. 25, FIGS. 27, 28, and 29 show another embodiment of a drill bit as claimed in the invention.

In the embodiment shown in FIG. 19, the drill bit 1 on its face has two cutters 2 which are curved in opposite directions and two straight cutters 2' which lie in the common axial plane of the drill bit 1.

Figure 20:
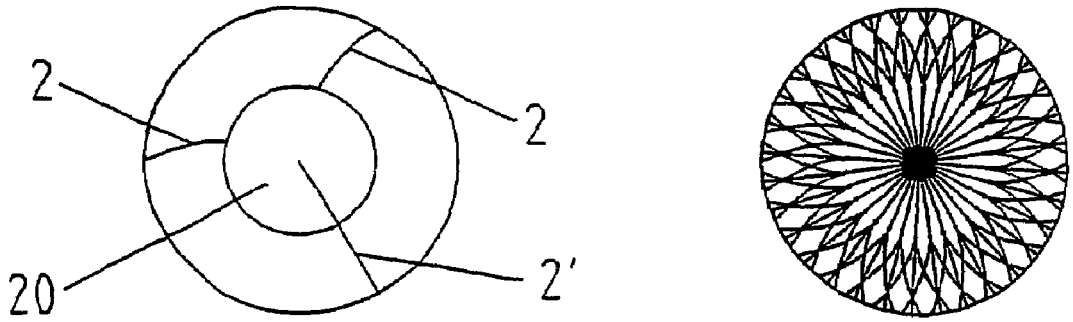

In the embodiment shown in FIG. 20 the drill bit 1 has a straight cutter 2' which extends to the middle (axis) of the drill bit, and two cutters 2 which are curved in opposite directions, which are located only in the outer area of the drill bit 1 and which are not diametrically opposite one another, but are located in the half of the face of the drill bit 1 which is opposite the straight cutter 2'.

Figure 21:
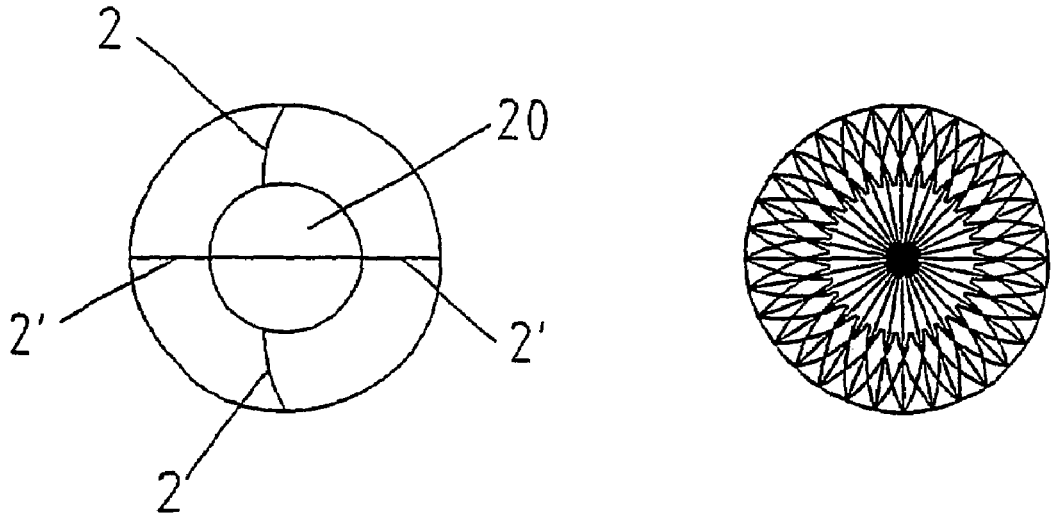

The curved cutters 2 both in the embodiment shown in FIGS. 20 and also the one shown in FIG. 21 extend as far as for example the circular depression 20 which is concentric to the axis of the drill bit 1 and which is located in the face of the drill bit.

In the embodiment of a drill bit 1 as claimed in the invention which is shown in FIG. 21, there are two diametrically opposite straight cutters 2', therefore straight cutters which lie in the axial plane of the drill bit 1, and two diametrically opposite cutters 2 which are curved in opposite directions and which extend from the outside edge of the face of the drill bit 2 as far as the depression 20.

The embodiment of a drill bit as claimed in the invention which is shown in FIGS. 22 to 26 has an arrangement of the cutters 2 and thus of the cutting edges 3 which on their face corresponds to FIG. 10 and when used for rotary percussive drilling yields the stop picture shown likewise in FIG. 10 (right).

The embodiment of the drill bit as claimed in the invention which is shown in FIGS. 22 to 26, proceeding from its blind hole 5, has three channels 10 which lead from the outside peripheral surface 13 of the drill bit 1 and which in the area of the concavely curved surfaces 12 discharge in the outside surface 13 of the drill bit 1, in a manner similar to the case in the embodiment of the drill bit which is shown in FIGS. 1 to 8.

The embodiment of the drill bit 1 shown in FIGS. 27 to 31 likewise has a combination of curved cutters 2 with one straight cutter 1, both the curved cutters 2 and thus their cutting edges 3 as well as the straight cutter 2' and its cutting edge 3' end at a distance from the axis 4 of the drill bit 1 of FIGS. 27 to 31.

Figure 27:
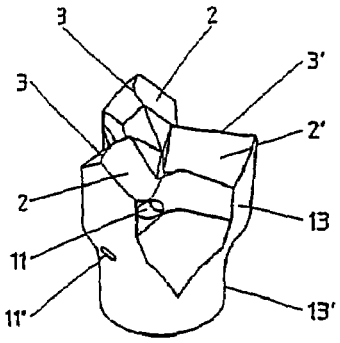
Figure 28:
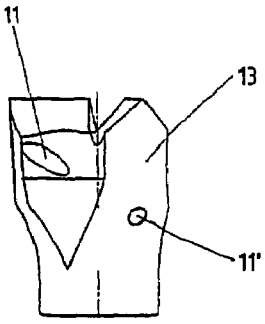
Figure 29:
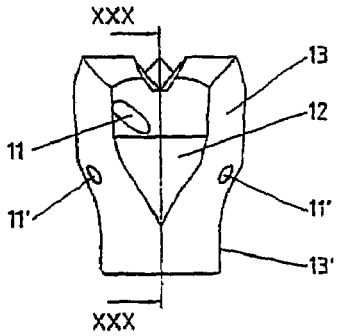
Figure 30:
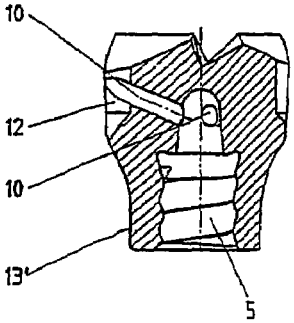
FIG. 30 shows a section of line XXX—XXX in FIG. 29
Figure 31:
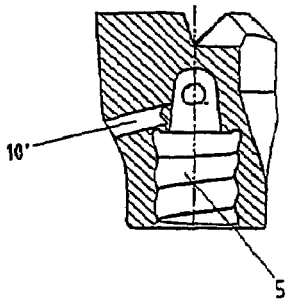
FIG. 31 shows another section through the drill bit of FIGS. 27, 28 and 29.

In the embodiment of the drill bits as shown in FIG. 27, proceeding from the blind hole 5 of the drill bit 1 there are three channels 10 which are aligned, as has been described beforehand using FIGS. 1 to 8 and 23 to 26, specifically to the face of the drill bit 1. The mouths 11 of the channels 10 are located off-center to the concavely curved surfaces 12 (compare FIG. 29). Preferably the mouths 11 of the channels 10 in the section of the surfaces 12 which lies forward in the direction of rotation of the drill bit 1 (in FIGS. 27 to 31 the drill bit 1 is designed for rotation clockwise) lie so to speak in the shadow of the edges between the jacket surface 13 of the drill bit 1 and the concave surfaces 12. Thus the entry of drillings into the channels 10 is prevented even better than for the mouths 11 which are located in the middle in the surfaces 12 (compare FIG. 22). Between these channels 10 there are other channels 10' which discharge in the outside surface 13 of the drill bit 1 between the concavely curved surfaces 12, as can be seen for example from FIGS. 28 and 29. These channels 10' discharge in a concavely retracted section of the outside surface 13 of the drill bit 1. Here the channels 10 of the drill bit 1 which is shown in FIGS. 27 to 31, as well as the channels 10 of the embodiments of the drill bit 1 which are shown on the one hand in FIGS. 1 to 8 and FIGS. 22 to 26 on the other relative to the axis 4 of the drill bit 1 are slanted pointing toward the front end (face) of the drill bit 1. The channels 10' conversely are obliquely aligned to the axis 4 of the drill bit 1 toward their end, therefore tilted away from the face of the drill bit, from which the blind hole 5 proceeds, and their mouths 11' lie in a tapering section 13' of the outside surface 13 of the drill bit 1. In this alignment of the channels 10' the entry of drillings into the channels 10' is prevented. In addition, this alignment has the advantage that the flushing medium can enter the drilled hole without sharp deflection of its flow out of the channels 10'.

Even if FIGS. 27 to 31 show a drill bit 1 with channels 10 and 10', a drill bit as claimed in the invention can also be equipped exclusively with the channels 10 shown as in this Figure or exclusively with channels 10'.

In summary, one preferred embodiment of the drill bit as claimed in the invention can be described as follows:

A drill bit 1 on its face has solely curved cutters 2 or a combination of at least one straight cutter 2' with at least two curved cutters 2. The cutters 2, 2' on the face of the drill bit 1 are arranged such that they proceed from the axis 4 of the drill bit 1 or end directly adjacent to it. Channels 10 proceed from the blind hole 5 which is used to attach the drill bit 1 to the anchor rod of an injection drill anchor. Their mouths 11 are not located in the area of the end face of the drill bit 1, but in the area of its lateral outside surface 13 which widens conically to the cutters 2, 2'. The mouths 11 of the channels 10 in the area of the concave depressions 12 of the jacket surface 13 of the drill bit 1 are located such that they are arranged set back relative to the periphery of the face of the drill bit 1.

The invention claimed is:

1. A drill bit (1), comprising:

a straight cutter (2') and two curved cutters (2) arranged in a Y-shape on a face of the drill bit for removing and/or crushing material to be worked;

said straight cutter being in a first part of the face of the drill bit that is diametrically opposite to a second part of the face of the drill bit in which said two curved cutters are located, said straight cutter being located symmetrically with respect to said two curved cutters; and said two curved cutters being located opposite to each other and curved in opposite directions with reference to a direction of rotation of the drill bit and having concave sides that open toward the first part of the face of the drill bit.

2. The drill bit of claim 1, wherein said straight cutter and said two curved cutters have essentially a same angular interval from one another.

3. The drill bit of claim 1, wherein said straight cutter and said two curved cutters extend from an intersection of an axis of the drill bit with the face of the drill bit.

4. The drill bit of claim 3, further comprising an extension of said straight cutter from said intersection to an opposite edge of the face between said two curved cutters.

5. The drill bit of claim 1, further comprising a circular depression (20) in the face of the drill bit, said circular depression being concentric with an axis of the drill bit, wherein said two curved cutters do not extend inside said circular depression.

6. The drill bit of claim 5, wherein said straight cutter extends into said circular depression to an intersection of the axis of the drill bit with the face of the drill bit.

7. The drill bit of claim 6, further comprising an extension of said straight cutter from said intersection to an opposite edge of the face between said two curved cutters.

* * * * *